United States Patent [19]

Little

[11] 4,392,362

[45] Jul. 12, 1983

[54] MICRO MINIATURE REFRIGERATORS

[75] Inventor: William A. Little, Palo Alto, Calif.

[73] Assignee: The Board of Trustees of the Leland Stanford Junior University, Stanford, Calif.

[21] Appl. No.: 259,688

[22] Filed: May 1, 1981

Related U.S. Application Data

[63] Continuation-in-part of Ser. No. 23,245, Mar. 23, 1979, abandoned.

[51] Int. Cl.[3] ..... F25B 19/00

[52] U.S. Cl. ..... 62/514 R; 29/157.3 D; 156/633; 165/168; 165/185

[58] Field of Search ..... 62/6, 514 R; 29/157.3 D; 165/185, 168; 156/633

[56] References Cited

U.S. PATENT DOCUMENTS 3,782,132 1/1974 Lohoff ..... 165/185

FOREIGN PATENT DOCUMENTS 2708270 8/1978 Fed. Rep. of Germany ..... 165/168

1439080 6/1976 United Kingdom ..... 156/633

*Primary Examiner*—Ronald C. Capossela

*Attorney, Agent, or Firm*—LeBlanc, Nolan, Shur & Nies

[57] ABSTRACT

A microminiature cryogenic device for cooling in the milliwatt range includes a miniature refrigerator in which micron-sized fluid passages are defined in one or more internal surfaces of a laminate of glass or similar low thermal conductivity members by means of lithographic, etching or particle blasting techniques.

26 Claims, 23 Drawing Figures

MICRO MINIATURE REFRIGERATORS

This application is a continuation-in-part of pending application Ser. No. 23,245, filed Mar. 23, 1979 now abandoned.

BACKGROUND

This invention relates generally to refrigeration and more particularly the invention relates to microminiature refrigerators and method of making same.

Certain materials, called superconductors, have the ability to pass electric current without resistance. Since superconductivity is observed only at temperatures close to absolute zero, one of the main obstacles to extensive use of superconducting devices is the need for reliable, continuous refrigeration. Superconducting devices, such as supersensitive magnetometers, voltmeters, ammeters, voltage standards, current comparators, etc., require a cryogenic environment to operate. Traditionally this has been provided by a bath of liquid helium. The helium is liquified elsewhere and transported to, and transferred to the device Dewar. The labor and complexity of such an operation has severely limited the use of these devices. Many of the above superconducting devices dissipate only a few microwatts in operation while the available cryogenic systems provide a refrigeration capacity of watts, thus the devices are poorly matched to the refrigeration.

In addition, many devices such as optical microscope stages, x-ray diffraction sample holders, electron microscope cold stages, devices for cryosurgery in the brain, for ECG, MCG and EKG measurements, and low noise amplifiers require or benefit from subambient operating temperatures.

Additionally, there are a number of high speed, high power devices such as VLSI (very large scale integration) chips and transmitters that are small, on the order of a centimeter square, and dissipate large amounts of heat, on the order of 10 to 50 watts. Traditional cooling devices, such as fans for convection cooling, are not capable of dissipating this amount of heat without significant increases in temperature above ambient.

Miniature closed cycle refrigerators such as those based on the Gifford-McMahon cycle, Vuilleumier, Stirling, etc., have been developed. These refrigerators, with capacities in the range of 0.5–10 watts, are convenient and compact but, because of their moving parts, they introduce a large amount of vibration and magnetic noise which interferes with the operation of the devices. Miniature Joule-Thomson refrigeration systems have been developed which have a cooling capacity typically between 0.5–10 watts. The design configurations of these compact systems are generally helically finned tubes coiled around a mandrel, the high-pressure gas flowing inside the tubes and the low-pressure gas flowing outside the tubes. Such helically finned and coiled heat exchangers are fabricated by laborious welding or soldering of the individual components. Because of the intricacy of the device, microminiature refrigerators with milliwatt capacities until now have not been made practically available.

What is needed for many devices is a microminiature refrigerator of approximately ½" to 4" in size with a cooling capacity in the milliwatt range. Also needed are microminiature refrigerator fabrication methods which avoid conventional laborious welding or soldering techniques and allow the formation of very small gas lines to operate the heat exchangers in the laminar flow regime and still have an efficient exchange of heat. The consequent absence of turbulence in the gas stream eliminates vibration and noise, both important considerations for superconducting device applications. The miniature size would allow the incorporation of an entire cryogenic system-superconducting sensor as a hybrid component in electronic circuitry. The microminiature refrigeration capacity would allow the matching of the refrigeration system to the load. The invention meets these needs.

Also needed are microminiature refrigerators of the same general dimensions as discussed above that can dissipate large amounts of heat, 10–50 watts, generated by certain small devices while maintaining ambient or subambient operating temperatures. And such refrigerators should be easy to manufacture and in configurations that are compatible with standard electronic packaging.

A microminiature refrigerator requires scaling down a conventional refrigerator by a factor of about a thousand. The design parameters for a microminiature refrigerator of the same efficiency as a conventional refrigerator using turbulent flow are described in "Scaling of Miniature Cryocooler to Microminiature Size," by W. A. Little, published in NBS Special Publication in April, 1978, which is hereby incorporated by reference.

In summary, the diameter d of the heat exchanger tubing, 1 the length of the exchanger and t the cool-down time are related to the capacity which is proportional to $\dot{m}$ the mass flow, in the following manner:

$$d \approx (\dot{m})^{0.5}$$

$$l \approx (\dot{m})^{0.6}$$

$$t \approx (\dot{m})^{0.6}$$

A microminiature turbulent flow refrigerator with a capacity of a few milliwatts should have $d = 25\mu$ and l a few centimeters.

As the device becomes smaller and smaller, eventually the mass flow becomes too small to allow turbulent flow of the fluid to occur. Laminar flow operation then becomes possible without loss of refrigeration efficiency and gives improved performance.

The theoretical basis for designing microminiature refrigerators using laminar flow heat exchangers is discussed in "Design Considerations for Microminiature Refrigerators Using Laminar Flow Heat Exchangers," presented by W. A. Little at the Conference on Refrigeration for Cryogenic Sensors and Electronic Systems, Boulder, Colo., Oct. 6 and 7, 1980, which is hereby incorporated by reference.

For microminiature heat exchangers operating in the laminar flow region over the same pressure regime and having the same efficiency, the length of the exchanger (l) should be made proportional to the square of the diameter (d) of the exchanger tubing. For example, an Joule-Thomson exchanger operating with $N_2$ at 120 atmospheres, 5 cm long with fluid flow passages 110 microns wide and 6 microns deep should provide approximately 25 milliwatts cooling. Different refrigeration capacities can be obtained by varying the width of the channel with no change of the efficiency. One may thus operate under stream-lined conditions free of vibration and turbulence noise, an advantage, particularly for superconducting devices, which require a very low noise environment.

In a Joule-Thomson refrigerator of this type it is normally convenient to use a capillary channel to throttle the compressed gas; however, it is common knowledge that a porous structure such as porous metal, sintered ceramic, etc. can be used equally well for throttling the gas.

In order to construct microminiature refrigerators, new fabrication techniques are needed for producing heat exchangers and expansion nozzles, a factor of 100 to 1,000 times smaller than those of conventional refrigerators.

Conventional fabrication techniques are ill-suited for microminiaturization since channels of the order to 5–500 microns must be formed accurately and the device must be sealed so as to withstand high pressure of the order of 150–3000 psi for refrigeration efficiency.

Accordingly, an object of the present invention is a novel refrigerator.

Another object of the present invention is a novel microminiature refrigerator with a cooling capacity ranging from milliwatts up to 50 watts or more.

Another object of the invention is a novel single-stage cryogenic microminiature refrigerator.

Another object of the invention is a novel multistage cryogenic microminiature refrigerator.

Another object of the invention is a novel method of manufacturing a microminiature refrigerator.

Yet another object of the invention is a novel method of making a microminiature refrigerator using photolithographic and chemical etching techniques.

Still another object of the invention is a novel method of making a microminiature refrigerator using a fine-particle sandblasting technique.

A further object of the invention is to provide a novel refrigerator of small size comprising two or more plates of a low thermal conductivity material such as glass bonded pressure-tight and containing at one or more plate interfaces micro-sized gas supply and return passages to a chamber that is adapted to continuously cool a superconductor or like device. Pursuant to this object the inlet gas pressures may be in the order of 150–3000 pounds per square inch, and the passages may be in the range of 5–500 microns wide and 5–60 microns deep.

Pursuant to the foregoing object of the passages and cooling chamber may be formed by recessing plate surface areas or forming raised channel walls at the interface or interfaces of the plates.

And still another object of the invention is a novel method of making a microminiature refrigerator by forming raised channel walls.

BRIEF DESCRIPTION OF DRAWINGS

Referring now to the drawings, FIG. 1 is a perspective exploded view of one embodiment of a microminiature refrigerator in accordance with the present invention and includes a body 12 in sealed surface contact with substrate 10. The body 12 is a crystalline (e.g., such as silicon), an amorphous (e.g., glass), or metallic (e.g., copper, stainless steel) material; and substrate 10 is a material such as Pyrex, soda glass or Kovar, having a coefficient of thermal expansion which is compatible with the coefficient of thermal expansion of the body 12. Preferably, the body 12 and substrate 10 are coextensive thin glass plates.

Figure 1:
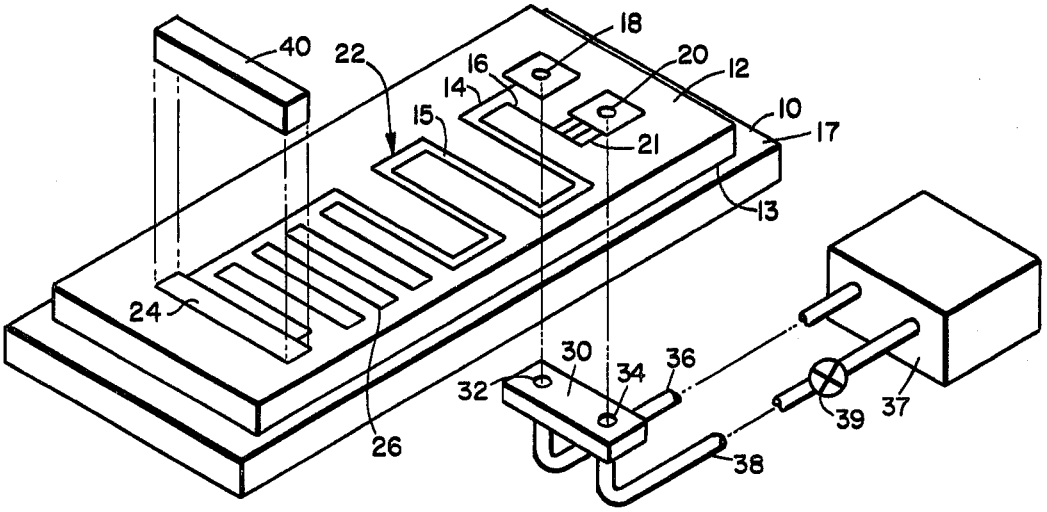
FIG. 1 is an exploded view showing a microminiature refrigerator according to one embodiment of the invention.

The body 12 and substrate 10 must be thick and/or strong enough to withstand the pressure of the incoming gas typically of the order of 150–3000 pounds per square inch pressure. For example, a silicon body may be approximately 300 microns (0.0118") thick, a glass body may be approximately 0.010" to 0.020" thick, and a glass substrate is about 0.010" to 0.020" thick. Formed on or etched in the surface of the body 12 which is mounted on substate 10 are parallel "serpentine" channels 14 and 16, 5–300 microns wide and separated by 150–500 microns walls 15. Channels 14 and 16 interconnect an outlet port 18 (the low-pressure return) and input port 20 (high-pressure inlet) respectively to a reservoir or cooling chamber 24. The size of reservoir 24 is determined by the desired reserve capacity needed for fluctuating demands. The foregoing channels and reservoir are formed in the bottom surface 13 of body 12 which is bonded flush onto the flat top surface 17 which effectively closes them. The interface consisting of surfaces 13 and 17 is bonded pressure-tight.

The channels 14 and 16 define respective low-pressure and high-pressure cooling lines which run in juxtaposition for an initial length and thereby define a heat exchanger section shown generally at 22. A fine channel filter section 21 is provided between the inlet and the heat exchange section. Beyond the heat exchanger section 22 the input channel 16 becomes independently sinuous and narrower at 26 of substrate 10 allowing the fluid to drop in pressure and then expand. As an example, channel section 22 is about 250 microns wide and 50 microns deep while channel 26 is about 125 microns wide and 10 microns deep. The end of the expansion line 26 is connected directly into the reservoir 24 and the output channel 14 extends from the reservoir 24 back through the heat exchanger to the output port 18. Reservoir 24 is preferably about 20–50 microns deep.

Mounted on the other or lower surface of substrate 10 is an interface unit 30 of suitable metal alloy such as Kovar which is an alloy of iron, nickel and cobalt with a coefficient of expansion about the same as the material of substrate 10 having holes 32 and 34 extending therethrough and communicating through aligned bores in substrate 10 with the ports 18 and 20 respectively of the body 12. Bonded to the interface unit 30 are a pair of miniature tubes 36 and 38 which communicate a fluid to and from the refrigerator. Tubes 36 and 38 may comprise stainless steel material as used in hypodermic needles or Teflon tubing. The interface unit 30 is attached pressure-tight to the substrate 10 by a suitable sealant such as epoxy.

Suitably mounted on the top surface of body 12 in direct abutment with the wall of the reservoir 24 is a device 40 to be cooled. The device 40 may be any one of a number of devices operated at a low temperature (e.g., supersensitive magnetometers, gradiometers, bolometers and other like devices which are based on the Josephson effect or other devices which are well known in the art) or devices for operating at higher temperatures (e.g., infra-red detectors, solid state lasers or samples whose physical properties are to be determined). The entire assembly may be contained in a Dewar or vacuum vessel to reduce the heat transfer to the parts.

The illustrated microminiature refrigerator is a Joule-Thomson, open-cycle refrigeration system in which tube 38 is connected through a control valve 39 to a container 37 of highly compressed refrigerant gas such as nitrogen, hydrogen or helium.

The highly compressed gas enters at an inlet pressure of approximately 150–3000 pounds per square inch and a flow rate of approximately 5–50 milliliters/sec (STP) through port 20 and passes through the heat exchanger 22 where the gas is cooled by lower-pressure supercooled gas exiting the device through channel 14, port 18 and tube 36. The high-pressure gas exits the heat exchanger 22 and passes through the capillary expander 26 where the drop in pressure reduces the temperature of the gas which enters the reservoir 24 as a supercooled or cryogenic fluid. The low-temperature reservoir 24 in turn cools the device 40 mounted on reservoir 24 and the absorbed heat causes the fluid to vaporize and it flows through channel 14 to the exhaust port 18.

An illustrative microminiature refrigerator whose body 12 is of 0.020″ thick glass ½ inches wide by 3 inches long has a refrigeration capacity of 100 milliwatts at 122° K.; channel dimensions are of the order of 100 microns and the flow rate about 30 milliliters/sec (STP) of nitrogen at an inlet pressure of 1600 pounds per square inch. The substrate 10 is a glass plate of the same size.

Another illustrative microminiature refrigerator whose body is silicon measures 75 by 12 by 2 millimeters, has a 30-centimeter-long heat exchanger section and operates from room temperature to 200° K. using $CO_2$.

A microminiature refrigerator can be approximately ½″ to 4″ in length, ½ inches wide, 0.040–0.060 inches thick with typical channel dimensions between 5–500 microns with separating walls 150–500 microns wide, can have a cooling capacity between 1.0–50,000 milliwatts at temperatures ranging from 2°–300° K., and can withstand input pressures from 150–3000 pounds per square inch. However, it should be appreciated that the microminiature refrigerator as described could be scaled up or down both in size and capacity for certain applications.

In addition to an open-cycle described above, it will be appreciated that the refrigerator can be a closed-cycle system using a compressor to recompress the gas. In addition, the method of fabrication described here could be used for the construction of parts of refrigerators using other cycles such as the Servel, Gifford-McMahon, pulsed tube and Vuilleumier systems.

Figure 2:
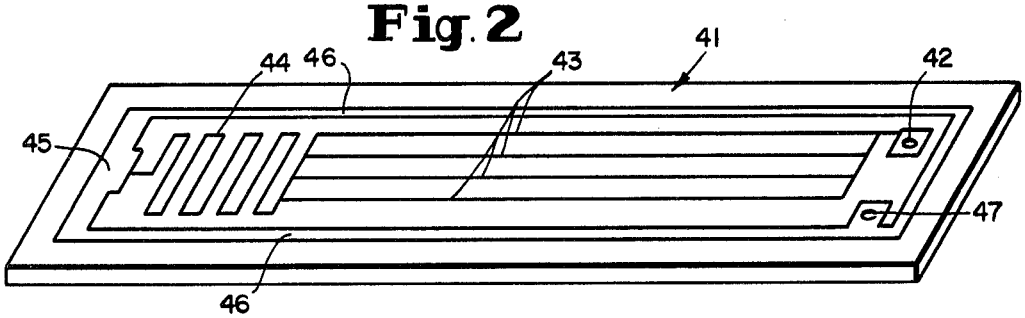
FIG. 2 is a generally plan view showing a microminiature refrigerator part having a fluid passage pattern according to a further embodiment.
Figure 3:
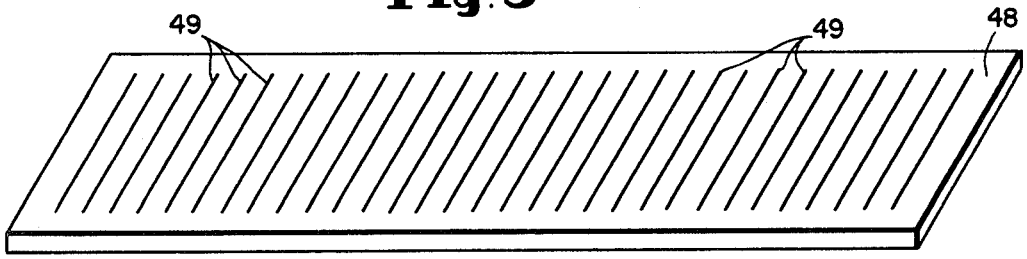
FIG. 3 is a generally perspective view showing a microminiature refrigerator part exhibiting a further modification.

In some of the laminar flow devices the design of the channels may be modified by having them straight as illustrated in FIG. 2 rather than "serpentine." FIG. 2 shows the bottom surface of such a body. In this embodiment, high-pressure gas enters at port 42, flows through the parallel heat exchanger channels 43 to the sinuous capillary channel section 44 thence to the reservoir or cooling chamber 45, through the low-pressure return 46 to the outlet port 47. An advantage of this design is that the low-pressure return 46 as shown completely surrounds the high-pressure channel lines so that any minor gas leak from a high-pressure line is captured by the low-pressure return and does not escape into the surrounding vacuum, which insulates the refrigerator from the environment. A possible disadvantage of this design is the long path for the heat to travel through the glass at the heat exchange section between the incoming lines 43 and outgoing channel 46. This difficulty may be avoided by combining the glass body with a glass substrate 48 shown in FIG. 3 which has highly conducting transverse metal strips or wires 49 printed or bonded respectively. These stripes or strips may be bonded upon the surface of the glass substrate that form the interface with body 41. These transverse conducting pieces 49 provide a high thermal conductive path laterally across the refrigerator while maintaining the thermal conductivity lengthwise along the refrigerator at a low value determined by the glass.

Figure 4:
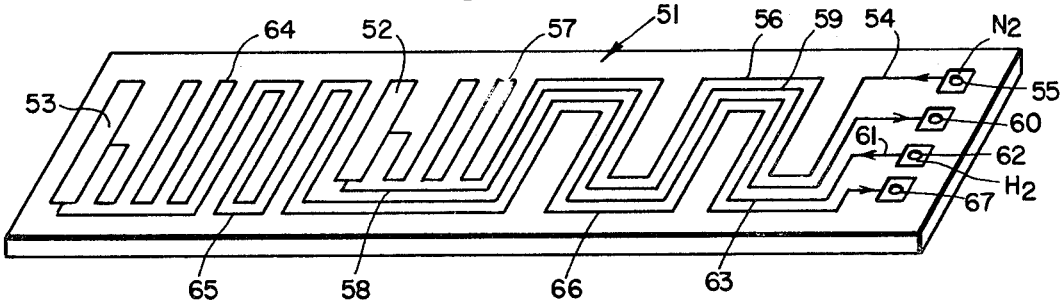
FIG. 4 is a plan view showing a multiple unit module embodiment of a microminiature refrigerator.

The microminiature cryogenic device and refrigerator of this invention also lends itself to multiple unit configurations. For example, a plurality of refrigerators, each using a different coolant, will provide cascade cooling of one gas by another and thus produce refrigeration at extremely low temperatures. Additional ports can be included in the device with channels interconnecting the additional ports as described and additional reservoirs for further cooling of a cryogenic device. FIG. 4 shows in perspective a multiple glass unit body module 51 of a microminiature refrigerator in accordance with this phase of the present invention.

There are two reservoirs or coolant chambers 52 and 53. Chamber 52 has an input line 54 leading from input port 55 through a sinuous heat exchange section 56 and a fine capillary section 57 into the chamber, and an output line 58 that has a sinuous heat exchange section 59 coextensive with section 56 leading to output port 60. Chamber 53 has an input line 61 leading from an input port 62 through a sinuous heat exchange section 63 and a capillary section 64 into the chamber, and an output line 65 that has a sinuous heat exchange section 66 coextensive with section 63 leading to output port 67. A source of high-pressure nitrogen is connected to port 55, and a source of high-pressure hydrogen is attached to port 62. The two circuits thus are partially interactive whereby the fluid going to chamber 53 is precooled more extensively before expansion. One circuit uses Joule-Thomson expansion of nitrogen to cool hydrogen to 77° K. at chamber 52. The other circuit uses Joule-Thomson expansion of the precooled hydrogen to reach 21° K. at chamber 53. The entire refrigerator as shown comprises two heat exchangers, two expansion sections, two cold liquid reservoirs, and the input and output ports. The size of the device is approximately 2″ to 51″. Similarly, a three-stage system using nitrogen, hydrogen and helium will produce cooling at 4.5° K.

Figure 5:
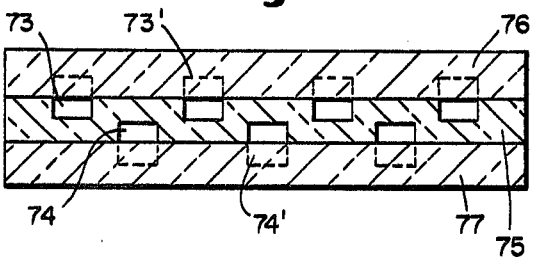
FIG. 5 is a cross sectional view showing another embodiment of a microminiature refrigerator.

FIG. 5 is a cross sectional view of another embodiment showing a multilayer microminiature refrigerator where the incoming and outgoing channel formations 73 and 74 are formed on either side or both sides of a glass body 75 and on either side or both sides of which are bonded two glass substrates or cover plates 76 and 77. High-pressure fluid flows along the channels 73 and returns through channels 74. The channels 73 and 74 may be etched or otherwise formed in the surfaces of body 75 as shown in full lines or etched or otherwise formed in the surfaces of either or both glass cover plates 76 and 77 that are bonded to the body as shown at 73' and 74' in dotted lines. The channels 73 and 74 may also be formed with raised channel walls on the body 75 or on the substrates 76 and 77. The channel formations 73 and 74 in each instance consist of inlet sections, heat exchange sections, capillary sections and cooling chambers which may be constructed and related as in FIGS. 1–4. The difference between FIG. 5 and FIG. 1 is that in FIG. 1 the incoming and outgoing channels may be described as formed in a single layer—that is, they are formed in the same or an abutting planar surface—whereas in FIG. 5 they are formed in a non-abutting surface. It is contemplated that in FIG. 1 the incoming and outgoing channels may be formed in the opposed surfaces 13 and 17 respectively.

Figure 6:
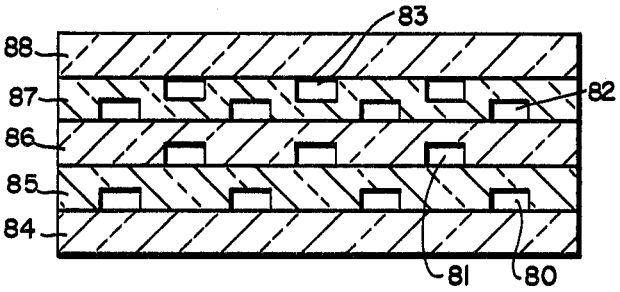
FIG. 6 is a cross sectional view showing another embodiment of a multiple unit module microminiature refrigerator.

FIG. 6 is a cross sectional view showing another embodiment of a multiple unit module microminiature refrigerator. Channels 80, 81, 82 and 83 are formed in facing surfaces of thin glass bodies 84, 85, 86, 87 and 88 by etching, particle blasting or by forming raised channel walls. For example, high-pressure nitrogen enters channel 80 and returns via low-pressure channel 81; and high-pressure hydrogen enters via channel 82 and is precooled by nitrogen in channel 81. Low-pressure hydrogen exits via channel 83. The inlets, heat exchange sections, expansion lines and reservoirs are included in the respective channels as in the earlier embodiments.

FABRICATION METHODS

Figure 7A:
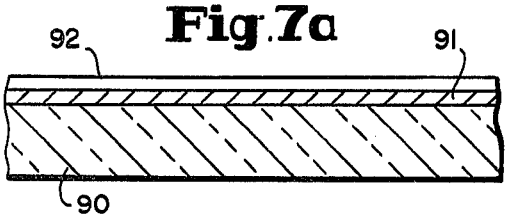
FIGS. 7A–7E are cross section views illustrating steps in a method of fabricating a microminiature refrigerator.
Figure 7B:
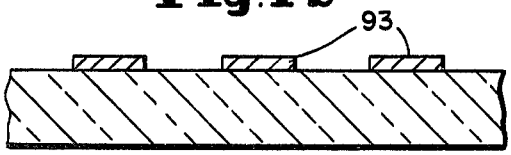
Figure 7C:
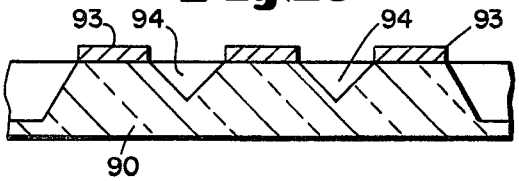
Figure 7D:
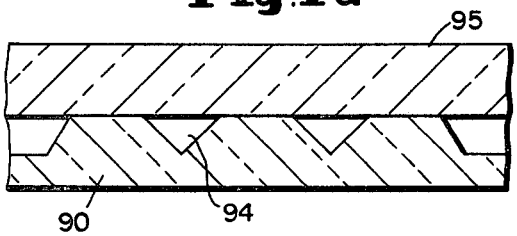
Figure 7E:
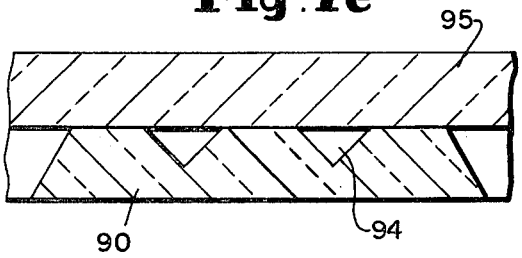

FIGS. 7A–7E illustrate one method of fabricating the refrigerator by etching channels in glass or silicon plates. The techniques to be described are to some extent well known in the manufacture of semiconductor devices, such as integrated circuits, and may include conventional photoresist masking and etching techniques. In one instance, by using a silicon plate material having a surface crystalline orientation on the (1,0,0) plane, anisotropic etching can be employed to form V-shaped grooves in the silicon plate surface. Alternately, vertical walls can be made using a silicon plate with a surface orientation of the (1,1,0) plane. In FIG. 7A a portion of a silicon plate 90 is shown in cross section and a silicon oxide layer 91 is provided on one major surface thereof. The plate 90 is on the order of 300 microns in thickness and oxide layer 91 is approximately 9,000 angstroms in thickness. The oxide layer may be formed by heating the silicon wafer in a wet oxygen atmosphere. Photoresist 92 is applied to the surface of silicon oxide 91 and is exposed under a photomask having the desired channel pattern. The photoresist is removed and the exposed oxide is etched leaving it in the pattern 93 as shown in FIG. 7B. The silicon oxide now acts as a mask and the exposed silicon is etched using an anisotropic etchant, such as ethylene diamine, resulting in the V-grooves 94 shown in FIG. 7C. Upon completion of the etching of the V-grooves, the remaining oxide layer 93 is removed from the silicon plate and the plate is cleaned. An optically flat Pyrex or equivalent glass plate 95 is then bonded to the etched surface of silicon plate 90, as shown in FIG. 7D. The bonding to the glass to the silicon surface is performed by known field assisted or anodic bonding techniques. Thereafter, as shown in FIG. 7E, the silicon plate 90 is etched or otherwise cut from the backside to reduce the thickness of the assembly and hence the thermal conductance of the laminated refrigerator structure.

Input and output lines are then drilled or etched in the reverse side of the glass substrate 95, and the tubing gas lines are then bonded to the reverse side of the glass plate by means of epoxy. By using photolithographic definition and chemical etching, the entire refrigerator including heat exchanger, expansion line and liquid reservoir channel formations can be formed in one step. Electron beam or x-ray lithography electrolytic and plasma etching can be employed as well as chemical etching. The foregoing photoresist method may be used where the body and substrate are both glass plates, using conventional materials and techniques.

Figure 8A:
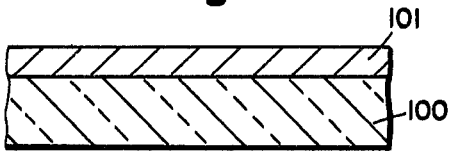
FIGS. 8A–8D are cross section views showing steps in another method of fabricating a microminiature refrigerator.
Figure 8B:
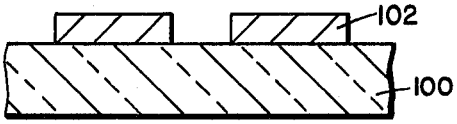

FIGS. 8A–8D illustrate a possibly preferred method of fabricating recessed channel formations in a hard, amorphous isotropic material such as glass or crystalline material such as silicon. The method allows good size control, improved resolution compared to chemical etching, eliminates undercutting and allows the formation of vertical walls. This method is not limited to the manufacture of the microminiature refrigerator. In FIG. 8A, a portion of a glass plate 100 approximately 0.020" thick is shown in cross section and a resist layer 101 is provided on one major surface thereof. The purpose of this resist layer is to protect the underlying surface and to provide a pattern for channel layout. The resist may be a photosensitive or non-photosensitive resist but must be resilient or tenacious enough to be able to withstand fine-particle "sand-blasting" as will be described below. The resist may cover the surface of the entire plate 100 or be screen-printed on plate 100 so as to form a pattern. If the resist is a photoresist, it is exposed through a conventional photo mask to ultraviolet light in order to define a pattern. A novel photoresist which meets the requirements of being able to withstand fine-particle sand-blasting is comprised of: 7 grams gelatin (e.g., Knox) and 1 grams ammonia bichromate dissolved in 50 cc hot water. The resist forms a thick, spongy layer approximately 20–30 times the thickness of conventional resists. The unexposed portions of the resist can be removed by hot water, or by using the enzyme, protease, to digest the unexposed portion, and result in the structure shown in FIG. 8B. The remaining resist 102 is tough and resilient, able to withstand the abrasive action of fine-particle "sand-blasting" while allowing exposed areas of the glass plate surface be abraded away. A miniature air abrasive device (e.g., Airbrasive Unit, Model K; S.S. White), which entrains a stream of fine alumina particles at 80 pounds per square inch acts as a fine particle "sand-blast." The "sand-blast" device is scanned at a constant rate across the resist carrying plate surface of FIG. 8B; and a jet of 17 micron particle abrasive powder can be used to remove approximately 2 microns of material at each pass. Larger powder particles (e.g., 27 and 50 microns) etch more rapidly but may give poorer definition. They may be used for fabricating larger devices with adequate accuracy.

Figure 8C:
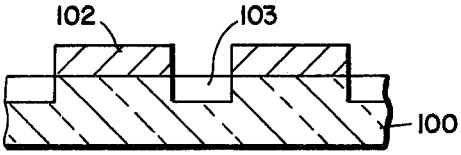
Figure 8D:
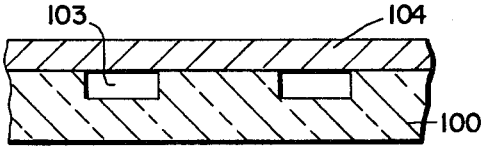

Channels 103 formed by this particle-blast method, as shown in FIG. 8C, have a precisely controlled depth (2–300 microns), vertical walls and edge definition of approximately 5 microns roughness. Upon completion of the formation of the recessed channels, the remaining photoresist is removed and the plate 100 cleaned. The entire refrigerator cooling chamber and passage system can thus be formed in one step. As shown in FIG. 8D a substrate 104, such as a soda glass cover slide, is bonded to the etched surface of glass plate 100 with an adhesive bond less than 10 microns thick but able to withstand 500–3,000 psi. This is the same mode of bonding used in all embodiments for securing two or more glass plates together to form a permanent pressure-tight assembly. Such as bond can be made with epoxy or ultraviolet curable cement (e.g., Norland's Optical Adhesive). A micron-thick seal can be made by drawing diluted adhesive into the space between the plate 100 and substrate 104 by capillary action. The refrigerator is then illuminated with intense ultraviolet radiation until the adhesive polymerizes and forms a bond.

Alternately the cover plate or substrate may be fused to the etched body plate with a thin film of solder glass screen-printed on either plate or both plates, using conventional methods for the fabrication of liquid crystal displays. Input and output lines are drilled or etched in the reverse side of the glass substrate 104, and stainless steel hypodermic or Telfon tubing gas lines are then bonded to the reverse side of the glass plate 104 as by means of epoxy. By using the fine particle sandblasting technique, a hard amorphous isotropic material such as glass can be used for the body plate 100 of the refrigerator. The use of such materials avoids the problems associated with the high thermal conductivity of silicon and therefore lower temperatures can be achieved at the cold chamber end of the refrigerator.

Figure 9A:
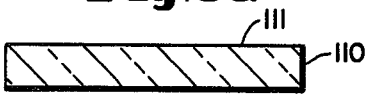
FIGS. 9A–9C are cross section views showing steps in a method of fabricating a microminiature refrigerator having raised channel walls.
Figure 9B:
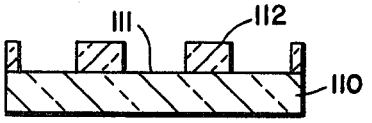
Figure 9C:
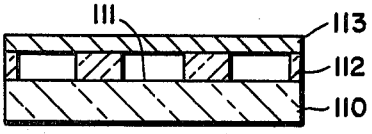

FIGS. 9A–9C illustrate a method of fabricating a microminiature refrigerator by forming raised channel walls on a surface as opposed to recessed channels in a surface. The plate 110 may be a crystalline, amorphous or metallic material, preferably glass on the plane surface 111 of which channels are to be formed. Material 112 such as glass frit powder, epoxy, solder glass, ultraviolet curable cement, etc. is screen-printed as a pattern onto the surface 111 as shown in FIG. 9B. Upon firing, the glass firt powder melts and defines the channel walls. Likewise, as the epoxy cures, solder glass hardens, or ultraviolet curable cement is exposed to ultraviolet radiation, the channel walls are formed. 5–300 Micron spacings are accurately made using this technique. FIG. 9C shows a glass substrate plate 113 bonded by any of the previously mentioned bonding methods to seal the gas exchanger lines. As before, input and output lines are then drilled or etched in the reverse side of plate 113, and the gas lines are then bonded to the reverse side of plate 113.

Figure 10A:
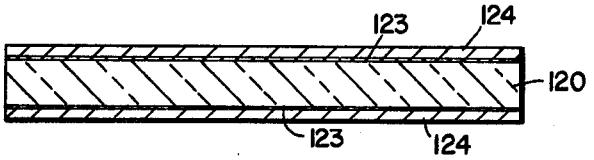
FIGS. 10A–10D are cross section views showing steps in another method of fabricating a microminiature refrigerator.
Figure 10B:
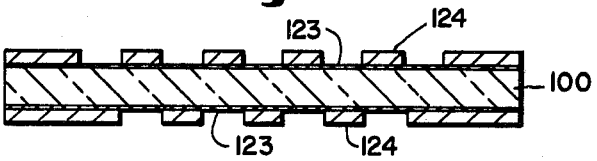
Figure 10C:
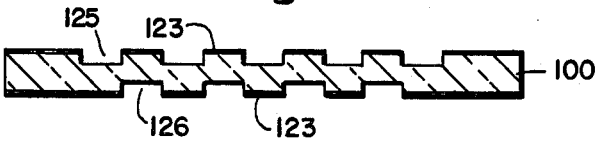
Figure 10D:
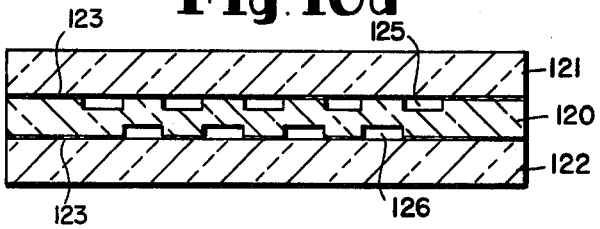

FIGS. 10A–10D show a method for the fabrication of the refrigerator such as that of FIG. 5 where the channels are etched on either or both planar sides of a glass plate 120 on which are to be bonded the two glass plates 121 and 122 (FIG. 10D). Particularly for the laminar flow design, this simplifies the design of multistage devices.

To fabricate the device the plate 120 is screen-printed with a thin continuous layer of glass frit or covered with solder glass 123 on each side (the same process may be done on one side only); these layers are then fused, as in the method step shown in FIG. 10A. Then a resist 124 is either printed on the top and bottom surfaces; or a photoresist is used, exposed and developed on each side at 124 (FIG. 10B), so that each side of the plate 120 bears the desired pattern, using one of the above disclosed methods. Plate 120 now is abraded and the resist removed, leaving the plate 120 as shown in FIG. 10C. It will be noted that at this point the channel formations 125 and 126 respectively appear in separate layers, and the glass surfaces between them are covered with the fused-on frit 123.

Cover glass plates 121 and 122 are then bonded upon the top and bottom surfaces by a program that may include first heating the entire assembly to the softening temperature of the solder glass or frit. This also seals the inlet port and the outlet port to complete the refrigerator (FIG. 10D). Holes through the plate at the cold or cooling chamber end connect the reservoir, which is connected via the capillary to the high-pressure channels 125, to the low-pressure channels 126. High-pressure gas passes through channels 125 to the cooling chamber and then back through channels 126. The channel layers may be formed in either or both substrate plates 121 and 122 instead of entirely in body plate 120.

Figure 11:
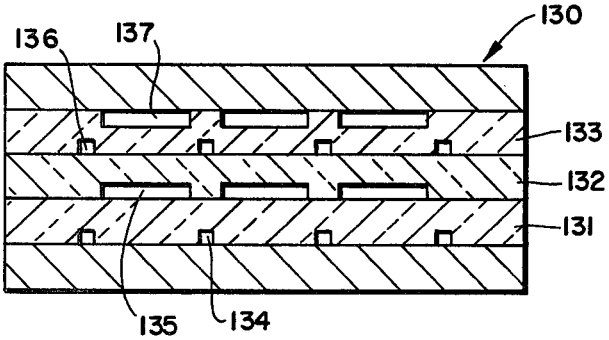
FIG. 11 is a cross section view showing fabrication of a multiple unit module embodiment.

FIG. 11 illustrates a method of fabricating a stacked multistage refrigerator 130 such as that of FIG. 6. By this procedure multistage devices may be conveniently constructed where the different gases pass in spaced layers through passages in a bonded stack of plates as illustrated in FIG. 11.

This refrigerator comprises five bonded glass plates preferably of the same size in a stack. Here the three intermediate plates 131, 132 and 133 are formed with surface recesses according to one of the foregoing methods. For example, plates 131 and 132 are formed with surface channels 134 and 135 respectively in accord with the methods of FIGS. 7A–7E, FIGS. 8A—8D or FIGS. 9A–9C; and plate 133 is formed on opposite sides with surface channels 136 and 137 respectively as by the method of FIGS. 10A–10D. In each case the particle blast mode is preferred whereby the open ends of each channel are spaced by fused frit layers on the glass surface.

In the two stage device illustrated high pressure nitrogen may enter via channel 134 and return via low pressure channel 135, high pressure hydrogen may enter via channel 136 and is precooled by heat exchange with nitrogen in channel 135. The low pressure hydrogen returns to the outlet port via channels 137. The whole assembly is bonded together with solder glass as disclosed earlier. Alternately plates having raised channel walls may be used instead of the recessed channels in this two-stage refrigeration assembly. The communicating ports between the various layers are suitably formed.

While in the described embodiments, the refrigerator has a crystalline or amorphous body, in some cases the refrigerator can be photoetched in a copper film on the surface of a circuit board or a thin sheet of stainless steel. While the described refrigerator is of the open-cycle type, as indicated above, closed-cycle refrigerators may be fabricated using the techniques in accordance with the present invention. It should be appreciated that the channels can be also formed as described above on capillary tubing with the tube in abutment with the confining internal surface of another tube to form a cylindrical heat exchanger refrigerator. The sealing of this tube to the inner one may be accomplished by using a heat shrinkable tubing such as Betalloy (Raychem Corp.) for the outer tube.

Refrigerators as above described are ideal for a wide range of laboratory and like applications. They provide convenient very low temperature economic operation as an alternative to volatile liquid cryogens. They are of small size and low weight enabling them to be used directly on instruments such as microscope stages. The small size enables them to be used to cool very small devices enabling tools or optical instruments to observe or work directly on the device without interference. Small gas consumption enables days of continuous use from a standard pressurized cylinder of gas. Temperature control is simple. The refrigerators are simple in structure and may be constructed and operated relatively simply and safely.

Channel dimensions, surface bonding techniques, channel forming and other characteristics of the refrigerator may be as disclosed in my co-pending application Ser. No. 259,687 filed on even date herewith entitled Refrigerators.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A compact refrigerator comprising a plurality of plate or platelike members all of materials having substantially the same coefficient of thermal expansion, means bonding said members together in sealed pressure-tight surface contact into a laminated structure and means forming in said structure a low-temperature chamber connected with input and output fluid ports by respective supply and return fluid passages, said supply passage being adapted for conducting incoming highly compressed gas and including a capillary or porous section leading into the cooling chamber whereby the incoming high-pressure gas is allowed to expand and reduce in temperature before entering said chamber, and said return passage having a section extending substantially coextensively in heat exchange relation adjacent at least part of said supply passage, and means whereby said chamber may be in heat exchange contact with a device to be cooled.

2. The refrigerator defined in claim 1, wherein said supply passage comprises an elongated inlet section extending in heat exchange relation with said return passage section and a smaller diameter capillary section that extends serially into said chamber.

3. A refrigerator defined in claim 1, wherein said passages are recessed channels formed in surfaces of one or more of said members.

4. A refrigerator as defined in claim 1, wherein said passages are channels with raised wall formed on surfaces of one or more of said members.

5. A refrigerator as defined in claim 1, wherein said members are glass or similarly low thermally conductive members.

6. A refrigerator as defined in claim 5, wherein said members are glass.

7. A refrigerator as defined in claim 1, wherein said passages are surface recess channels formed by lithographic and etching technique.

8. A refrigerator as defined in claim 1, wherein said passages are surface recess channels formed by fine-particle blasting.

9. A refrigerator as defined in claim 1, wherein said members as sealed in pressure contact and the bonds between them are able to withstand internal pressures above 800 pounds per square inch.

10. A refrigerator as defined in claim 1, having a cooling capacity between 1.0–50,000 milliwatts.

11. A refrigerator as defined in claim 10, operating in the temperature range of 2°–300° K.

12. A microminiature cryogenic refrigerator for cooling superconductor devices and the like comprising at least two members of materials having substantially the same coefficient of thermal expansion, means bonding said members together in pressure-tight contact over an interface area to provide a stiff laminate and means forming in said laminate a low-temperature chamber connected with an input fluid port by a micron-sized supply fluid passage along said interface area, said supply passage comprising a first section for conducting incoming highly compressed gas and a serially connected smaller diameter second capillary section opening into said chamber whereby the high-pressure gas is allowed to expand and reduce in temperature before entering said chamber, and a return passage having a section extending through the laminate substantially coextensively in counterflow heat exchange relation with said first section of said supply passage, and means whereby said chamber may be in heat exchange contact with a device to be cooled.

13. The cryogenic refrigerator defined in claim 12, wherein said members are predominantly silicon materials and said supply passage is a surface groove system recessed in the surface of one of said members.

14. The refrigerator defined in claim 12, wherein said return passage extends substantially continuously around said supply passage whereby to intercept gas leakage from said supply passage.

15. The refrigerator defined in claim 14, wherein a spaced series of heat conductor strips extend across the laminate angularly with respect to and in heat exchange relation with said passages.

16. A miniature refrigerator comprising a substrate having a confining surface, a planar member having a surface including a pattern formed thereon, said pattern defining a heat exchanger and a reservoir interconnected with said heat exchanger, said substrate and said planar member being cooperatively positioned with said pattern abutting said confining surface thereby forming refrigerant lines, and an input port and an output port interconnected with said heat exchanger for providing a refrigerant flow through said heat exchanger to said reservoir.

17. A miniature refrigerator as defined in claim 16, further including means for introducing refrigerant into said input port.

18. A miniature refrigerator as defined in claim 17, wherein said means for introducing refrigerant includes a block mounted on a surface of said substrate opposite to said planar member, a pair of lines connected to said block, and wherein said substrate includes a pair of holes extending therethrough and interconnecting said pair of lines to said input port and said output port.

19. A miniature refrigerator as defined in claim 16, wherein said substrate comprises glass, and said planar member comprises a glasslike material of about the same coefficient of thermal expansion.

20. The miniature refrigerator defined in claim 17, wherein said block is of Kovar and said lines are stainless steel tubing.

21. A miniature refrigerator as defined in claim 16, wherein said substrate comprises glass and said planar member comprises silicon.

22. A miniature refrigerator as defined in claim 16, wherein said pattern is recessed and defined by lithographic means and formed by etching.

23. A miniature refrigerator as defined in claim 16, wherein said planar member is silicon and its major surface has (1,0,0) crystalline orientation and said etching forms grooves by anisotropic etching.

24. A miniature refrigerator as defined in claim 16 or 23, further including a cryogenic device mounted to said second member in abutment with said reservoir.

25. A multiple unit miniature refrigerator providing cascade cooling comprising means defining two separate micron-sized fluid inlet passageways in a glass plate laminate, one of said passageways extending from a first input port through a first heat exchange section and a first capillary section in series to a first cooling chamber, and the other of said passageway extending from a second inlet port through a second heat exchange section disposed in heat exchange relation with said first heat exchange section and then serially through a third heat exchange section and a second capillary section to a second cooling chamber, and means providing separate return passageways in said laminate for conducting low-pressure fluid from each said chamber to separate outlet ports, the return passage from said first chamber extending in heat exchange relation to said first and second heat exchange sections, and said return passage from said second chamber extending in heat exchange relation with said third and second heat exchange sections.

26. A multiple unit miniature refrigerator as defined in claim 25, having three or more refrigerator stages.

* * * * *